US006485270B2

(12) United States Patent
Wang

(10) Patent No.: US 6,485,270 B2
(45) Date of Patent: Nov. 26, 2002

(54) AIR PUMP WITH NOISE SILENCE ARRANGEMENT

(75) Inventor: Chiao-Ming Wang, Taichung Hsien (TW)

(73) Assignee: Meiko Pet Corporation, Taichung Hsien (TW)

( * ) Notice: Subject to any disclaimer, the term of this patent is extended or adjusted under 35 U.S.C. 154(b) by 0 days.

(21) Appl. No.: 09/789,620

(22) Filed: Feb. 22, 2001

(65) Prior Publication Data

US 2002/0114711 A1 Aug. 22, 2002

(51) Int. Cl.[7] ..... F04B 39/10; F04B 53/16

(52) U.S. Cl. ..... 417/312; 417/313; 181/272; 181/264

(58) Field of Search ..... 417/312, 413.1, 417/542, 566, 313; 137/855; 181/403, 257, 264, 272, 230, 273, 275, 276, 281, 282, 265, 269, 212

(56) References Cited

U.S. PATENT DOCUMENTS

| | | | | | |
|---|---|---|---|---|---|
| 3,838,944 | A | * | 10/1974 | Kolfertz | 417/312 |
| 4,170,439 | A | * | 10/1979 | Hase | 417/413 |
| 4,762,470 | A | * | 8/1988 | Wang | 417/312 |
| 5,137,432 | A | * | 8/1992 | Tsai | 417/312 |
| 5,407,330 | A | * | 4/1995 | Rimington et al. | 417/312 |
| 6,007,307 | A | * | 12/1999 | Sonoda | 417/312 |
| 6,168,392 | B1 | * | 1/2001 | Takano | 417/312 |
| 6,340,069 | B1 | * | 1/2002 | Wang | 181/272 |

FOREIGN PATENT DOCUMENTS

JP 11-247764 A * 9/1999

* cited by examiner

*Primary Examiner*—Charles G. Freay
*Assistant Examiner*—Han Lieh Liu
(74) *Attorney, Agent, or Firm*—Rosenberg, Klein & Lee

(57) ABSTRACT

An air pump for a fish-tank comprises a compartmental air chamber assembly formed by a base plate and a casing in the body. Hence, an indirect prolonged air path is formed in the air chamber assembly, resulting in a great reduction of noise generated while operating.

5 Claims, 5 Drawing Sheets

AIR PUMP WITH NOISE SILENCE ARRANGEMENT

FIELD OF THE INVENTION

The present invention relates to air pump and more particularly to an air pump for a fish-tank with noise silence arrangement.

BACKGROUND OF THE INVENTION

A conventional air pump 10 for fish-tank is shown in FIG. 1 comprising a body 11, a cap 12, a front vibration mechanism 13 secured to cap 12 having a magnet 131 at one side, a pair of check mechanisms 14 with body 11 sandwiched therebetween, and a rear plate 15. Each of the components is detailed below. Body 11 comprises an inlet air chamber 111 with cap 12 clung onto, an outlet air chamber 112 divided from inlet air chamber 111 by a central wall, an inlet 113, an outlet 114 both on the central wall, a first slot 115 in inlet air chamber 111, a second slot 115 in outlet air chamber 112 wherein each check mechanism 14 is inserted in the corresponding slot 115, a discharge opening 116 on the bottom of inlet air chamber 111 in communication with the external of body 11, and a discharge pipe 117 on die side opposite to the discharge opening 116. Check mechanism 14 comprises a diaphragm 142 and a block member 141 for pressing diaphragm 142 onto slot 115 for releasably covering inlet 113 (or outlet 114). The rear side of body 11 is sealed by rear plate 15.

Operation: When air pump 10 is activated, an activated external electromagnetic device (not shown) will reciprocally attract and repulse the magnet 131, thus causing the magnet 131 to vibrate toward cap 12 about the other side of vibration mechanism 13. Hence, cap 12 is reciprocally pushed and pulled. When cap 12 is pulled up, external air will suck into inlet air chamber 111 through discharge opening 116. Then air is guided to outlet 114 through inlet 113. To the contrary when cap 12 is pushed down, internal air will be compressed into outlet air chamber 112 through outlet 114. Then the compressed air is discharged out of discharge pipe 117. As a result, fresh compressed air may be pumped into water in fish-tank by the reciprocation of vibration mechanism 13. However, the previous design suffered from a disadvantages, i.e., it is very noisy. This is because an air path within the air pump 10 (i.e., from inlet 113 to inlet air chamber 111) is short, resulting in a quick discharge of air. Thus, it is desirable to provide an air pump with prolonged air path for effectively attenuating noise when air pump is operating, thereby overcoming the above drawbacks of prior art.

SUMMARY OF THE INVENTION

It is an object of the present invention to provide an air pump for a fish-tank comprising a base plate; a body comprising a frame, an inlet air chamber, an outlet air chamber divided by the frame, a first and a second inlets at the inlet air chamber, a first and a second outlets at the outlet air chamber, a slot on each of the first inlet and the first outlet, a discharge pipe, and a bottom casing comprising an air charge opening on the top in communication with outside, a compartmental air chamber assembly, an air charge tube extended down from the air charge opening to the compartmental air chamber assembly, the bottom end of the air charge tube urged against the inner wall of the base plate, and one or more third outlets on the edge of the bottom end of the air charge tube; a cap clung onto the frame; a vibration mechanism secured to the outer surface of the cap, the vibration mechanism comprising a magnet at one side; a pair of check mechanisms with the body sandwiched therebetween, each of the check mechanisms clung to the corresponding slot and comprising a block member and a diaphragm for regulating air passing through the first inlet and the first outlet; a pad clung to the rear side of the body; and a rear plate clung to the rear side of the pad; wherein air is guided into the air chamber assembly prior to leaving the discharge pipe. By utilizing such indirect air path in the air chamber assembly, noise generated while air pump is operating is greatly reduced.

It is another object of the present invention to provide an air pump for a fish-tank comprising a pair of base plates; a body comprising a frame, an inlet air chamber, an outlet air chamber divided by the frame, a first and a second inlets at the inlet air chamber, a first and a second outlets at the outlet air chamber, a slot on each of the first inlet and the first outlet, a discharge pipe, and a bottom casing comprising an air charge opening on the top in communication with outside, a pair of compartmental air chamber assemblies, an air charge tube extended down from the air charge opening to one of the compartmental air chamber assemblies, the bottom end of the air charge tube urged against the inner wall of one of the base plates, and one or more third outlets on the edge of the bottom end of the air charge tube; a pair of caps each clung onto the frame; a pair of vibration mechanisms each secured to the outer surface of each cap, each vibration mechanism comprising a magnet at one side; a pair of check mechanisms with the body sandwiched therebetween, each of the check mechanisms clung to the corresponding slot and comprising a block member and a diaphragm for regulating air passing through the first inlet and the first outlet; a pad clung to the rear side of the body; and a rear plate clung to the rear side of the pad; wherein air is guided into the air chamber assemblies prior to leaving the discharge pipe. By utilizing such indirect air path in the air chamber assemblies, noise generated while air pump is operating is further greatly reduced.

The above and other objects, features and advantages of the present invention will become apparent from the following detailed description taken with the accompanying drawings.

DETAILED DESCRIPTION OF THE PREFERRED EMBODIMENTS

Figure 1:
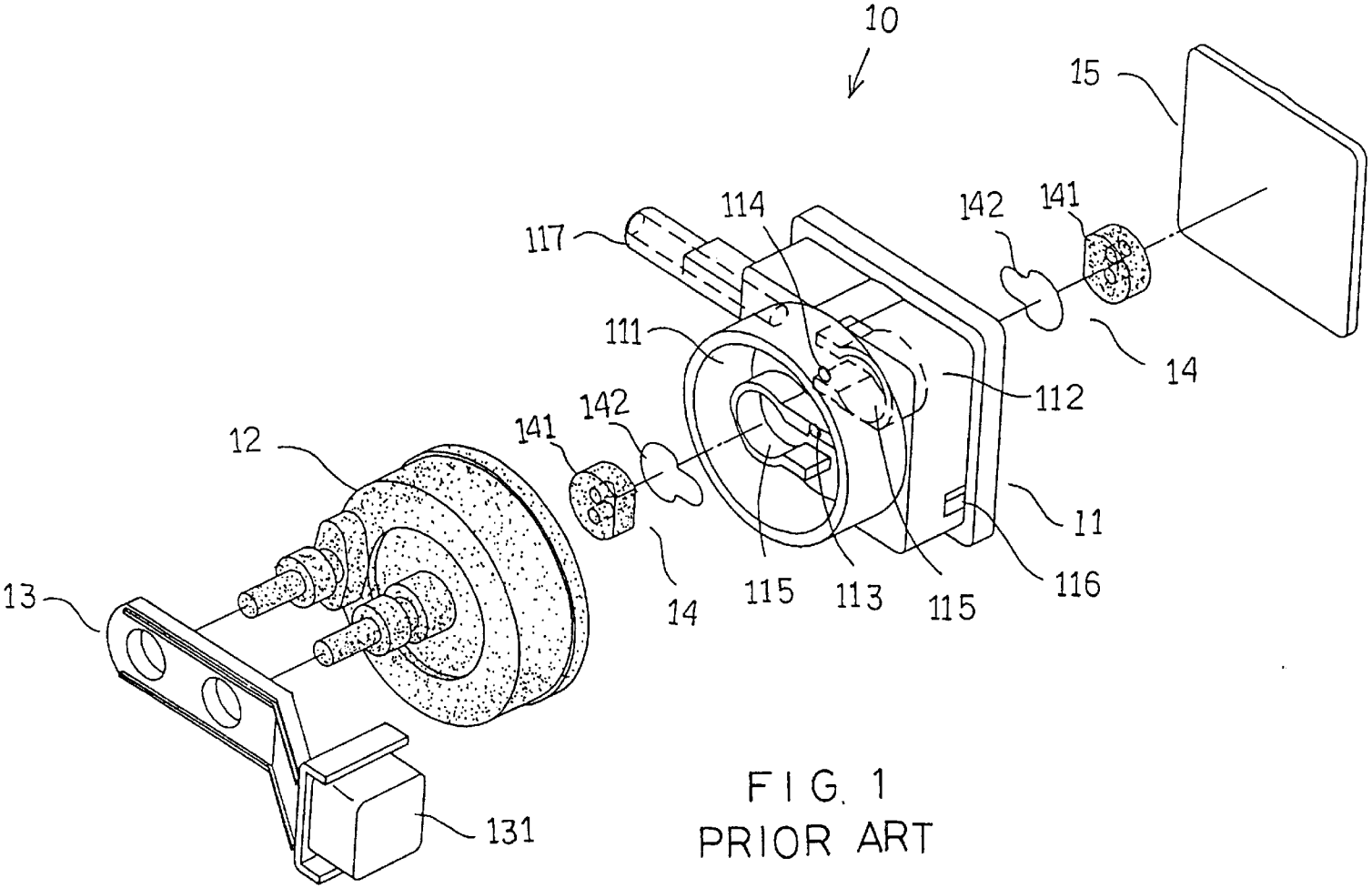
FIG. 1 PRIOR ART
FIG. 1 is an exploded view of a conventional air pump.
Figures 2, 3:
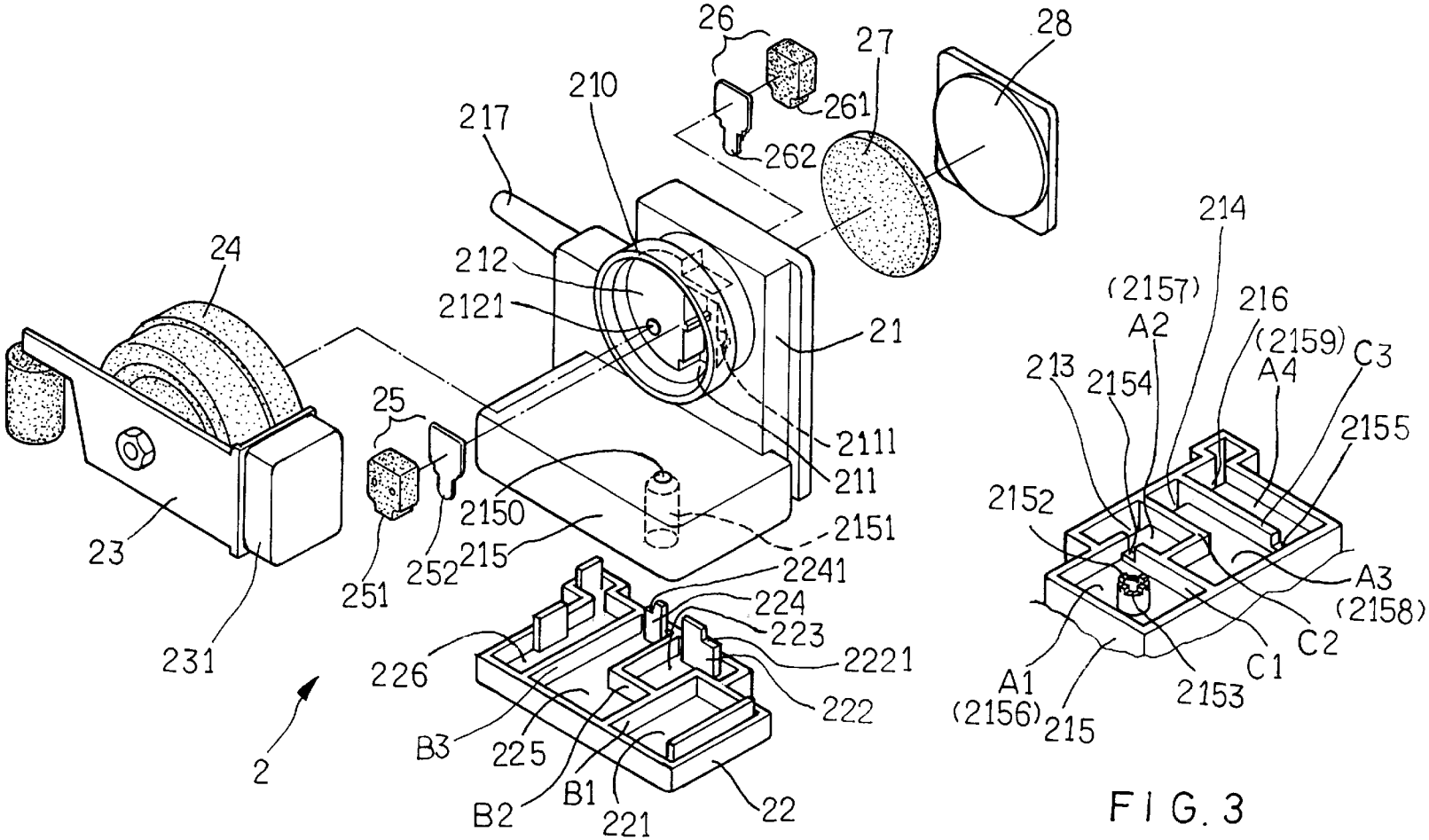
FIG. 2 is an exploded view of a first preferred embodiment of air pump with noise silence arrangement according to the invention.
FIG. 3 is a perspective view of casing of FIG. 2.

Referring to FIGS. 2 to 6, there is shown a first preferred embodiment of air pump 2 constructed in accordance with the invention comprising a body 21, a base plate 22, a cap 24, a vibration mechanism 23, a pair of check mechanisms 25 and 26 with body 21 sandwiched therebetween, a pad 27, and a rear plate 28. Each of the components is detailed below. An inlet air chamber 211 and an outlet air chamber 212 are divided by a circular frame 210 on body 21. Pad 27 and rear plate 28 are clung to the rear side of body 21. An inlet 2111 and an outlet 2121 are provided at inlet air chamber 211 and outlet air chamber 212 respectively. Cap 24 is clung onto frame 210. Vibration mechanism 23 is threadedly secured to the center of the outer surface of cap 24. Vibration mechanism 23 comprises a magnet 231 at one side. A slot (not shown) is formed on each of inlet 2111 and outlet 2121. Check mechanisms 25 and 26 are clung to the slots respectively. Check mechanism 25 (or 26) comprises a block member 251 (or 261) and a diaphragm 252 (or 262) for regulating air passing through inlet 2111 and outlet 2121. An inlet 213 is formed on inlet air chamber 211. An outlet 214 is formed on outlet air chamber 212. A noise silence arrangement is provided in a casing 215 at the bottom of body 21. In detail, casing 215 comprises an air charge opening 2150 on the top in communication with outside, an air charge tube 2151 extended down from air charge opening 2150 to a first air chamber A1, bottom end 2152 of air charge tube 2151 urged against the inner wall of compartment 221 on base plate 22, and one or more outlets 2153 formed on the edge of bottom end 2152 of air charge tube 2151 for guiding air into first air chamber A1 in order to avoid air from directly guiding into first air chamber A1 otherwise causing strong noise. Compartments 2156, 2157, 2158, and 2159 are formed in casing 215 by dividers C1, C2, and C3. Each of compartments 2156, 2157, 2158, and 2159 is matingly engaged with one of compartments 221, 223, 225, and 226 on base plate 22 to form a first air chamber A1, a second air chamber A2, a third air chamber A3, and a fourth air chamber A4 respectively. An opening 2154 is provided between first air chamber A1 and second air chamber A2. An inlet 213 is provided on a side of compartment 2157 in second air chamber A2 in communication with inlet air chamber 211. An outlet 214 is provided on a side of compartment 2158 in second air chamber A2 in communication with outlet air chamber 212. An opening 2155 is provided between third air chamber A3 and fourth air chamber A4. A passageway 216 is provided on a side of compartment 2159 in fourth air chamber A4 in communication with discharge pipe 117. Base plate 22 is clung to casing 215 to form a unit. Compartments 221, 223, 225, and 226 are formed in base plate 22 by dividers B1, B2, and B3. A riser 222 having a cross-sectional area slightly smaller than the diameter of inlet 213 is provided on a side of compartment 223 in second air chamber A2 corresponding to inlet 213. A recess 2221 is provided on riser 222. Similarly, a riser 224 having a cross-sectional area slightly smaller than the diameter of outlet 214 is provided on a side of compartment 225 in third air chamber A3 corresponding to outlet 214. A recess 2241 is provided on riser 224.

Figure 4:
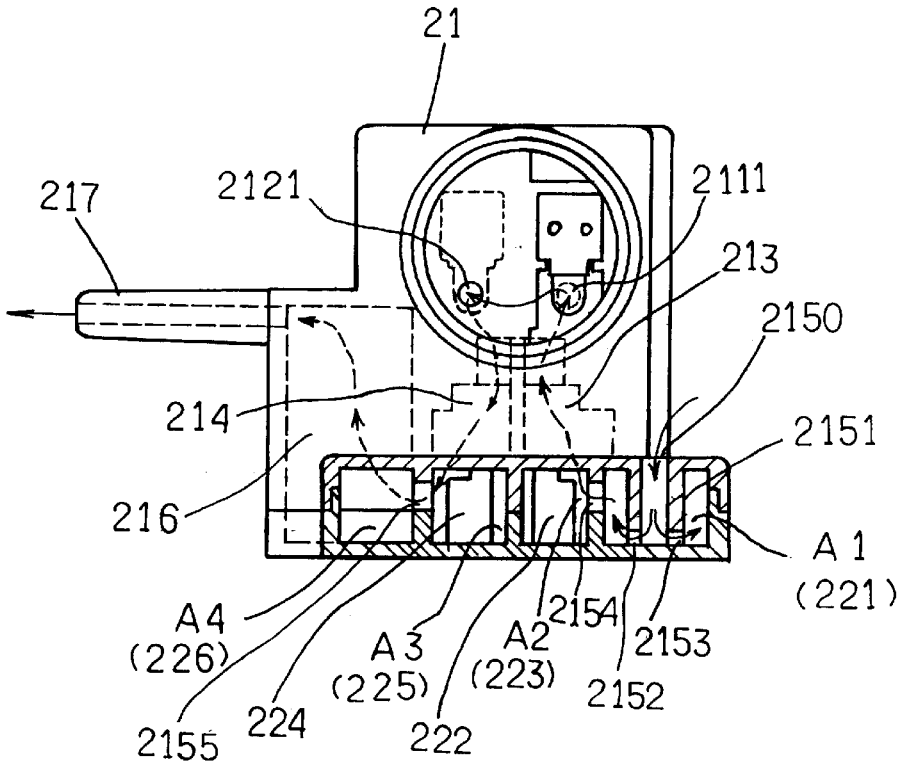
FIG. 4 is a sectional view illustrating an air path in the air pump of FIG. 2.
Figure 5:
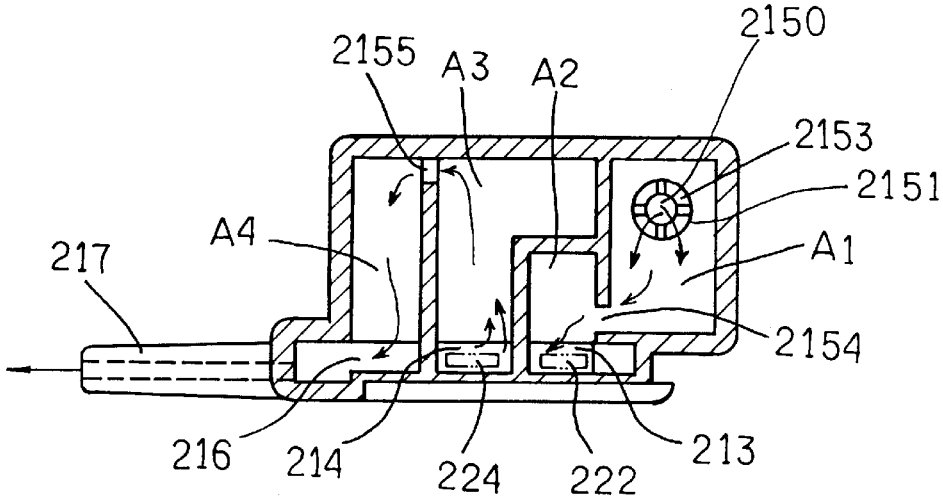
FIG. 5 is another sectional view further illustrating the air path of FIG. 4.
Figure 6:
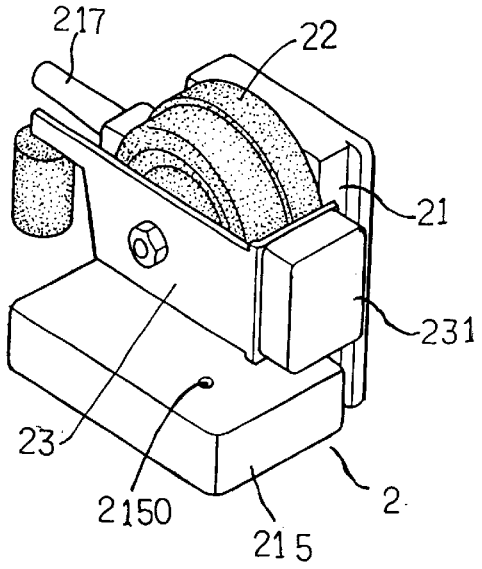
FIG. 6 is a perspective view of the assembled FIG. 2 air pump.

Operation: Referring to FIGS. 4 and 5 specifically, when air pump 20 is activated, an activated external electromagnetic device (not shown) will reciprocally attract and repulse the magnet 231, thus causing the magnet 231 to vibrate toward cap 24 about the other side of vibration mechanism 23. Hence, cap 24 is reciprocally pushed and pulled. When cap 24 is pulled up, external air will suck into air charge tube 2151 of casing 215 through air charge opening 2150. Then air is guided to first air chamber A1 through outlet 2153 on the periphery of bottom end 2152 of air charge tube 2151. As a result, noise mainly caused by air directly guiding into air chambers is attenuated by such indirect air path. Air is then guided from first air chamber A1 to second air chamber A2 through opening 2154. Air is partly blocked by riser 222 in the air chamber of inlet 213, thus preventing air from directly guiding into inlet 213. Instead, air is guided indirectly to inlet air chamber 211 through the gap between inlet 213 and riser 222 and recess 2221 of riser 222. This may further reduce noise. Air in inlet air chamber 211 is then guided to outlet 214 through check mechanisms 25 and 26, inlet 2111, outlet 2121, and outlet air chamber 212. Since the opening of outlet 214 is partly blocked by riser 224, thus guiding air indirectly to third air chamber A3 through the gap between outlet 214 and riser 224. This may furthermore reduce noise. Next air is guided from third air chamber A3 to fourth air chamber A4 through opening 2155. Finally, air is discharged from discharge pipe 217 through passageway 216. By utilizing such indirect air path, noise generated while air pump 20 is operating is greatly reduced.

Figure 7:
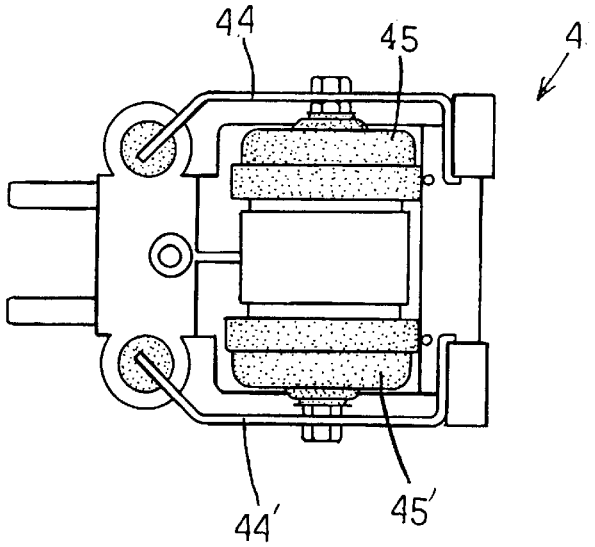
FIG. 7 is top view of a second preferred embodiment of air pump with noise silence arrangement according to the invention.
Figure 8:
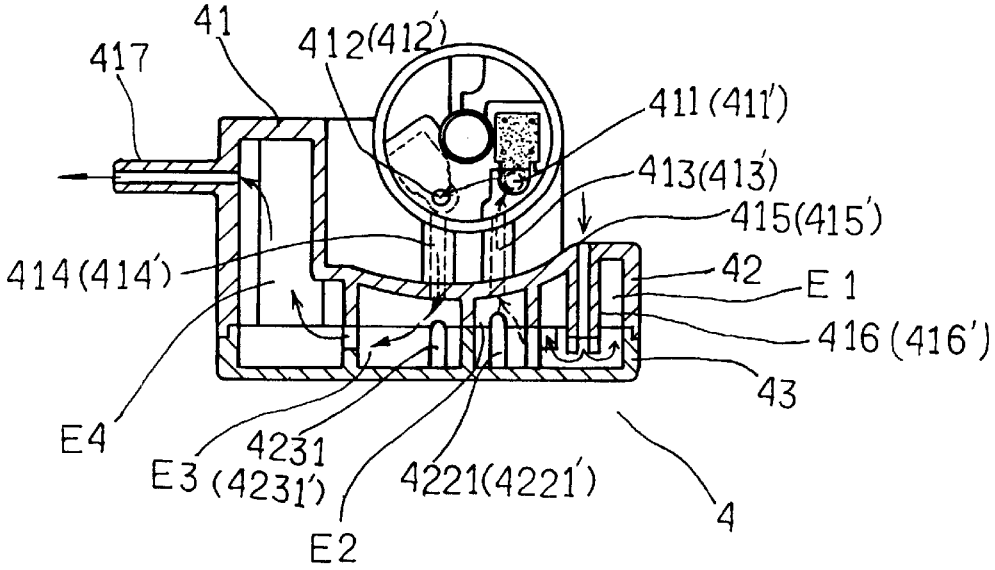
FIG. 8 is a sectional view illustrating an air path in the air pump of FIG. 7.
Figure 9:
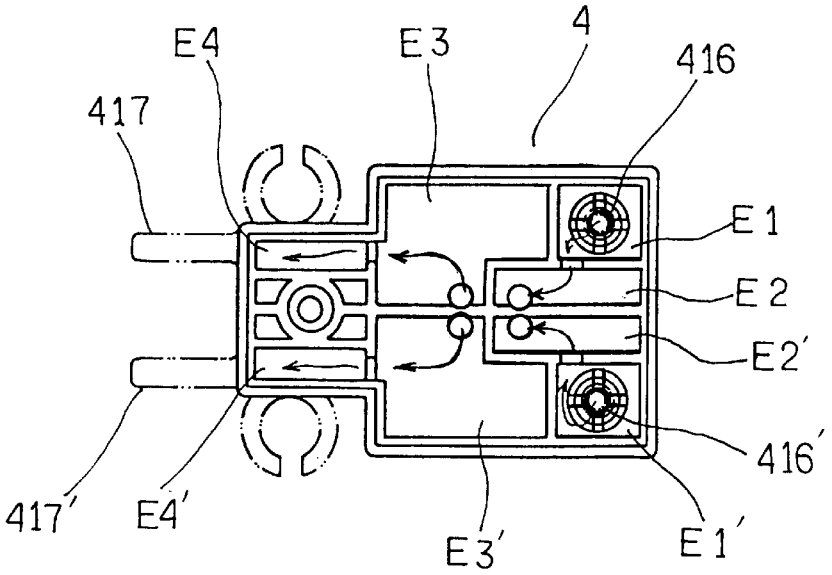
FIG. 9 is another sectional view further illustrating the air path of FIG. 8.

Referring to FIGS. 7, 8, and 9, a second preferred embodiment of air pump according to the invention is shown. The difference between first and second embodiments is that the later is double configured partly. For example, a first air path is formed in casing 42 in one side of body 41 and a second air path is formed in base plate 43 in the other side of body 41. Further, a pair of vibration mechanisms 44 and 44' and a pair of caps 45 and 45' are provided in cooperation with base plate 43 and case 42. The in and out arrangement of air is substantially the same as the first embodiment. For example, there are provided air charge openings 416 and 416', first air chambers E1 and E1', second air chambers E2 and E2', third air chambers E3 and E3', fourth air chambers E4 and E4', and discharge pipes 417 and 417'. Note that each of inlets 413 and 413' of inlet air chambers 411 and 411' has a round opening. Similarly, each of outlets 414 and 414' of outlet air chambers 412 and 412' has a round opening. Posts 4221, 4221', 4231, and 4231' are provided on second and third air chambers E2, E2', E3, and E3' of base plate 43 respectively. Each post is corresponding to one of the round openings. Hence, posts 4221, 4221', 4231, and 4231' are capable of inserting into the round openings. Note that the function of post is the same as riser in the first embodiment for partly blocking the incoming air. The cross-sectional area of each of posts 4221, 4221', 4231, and 4231' is slightly smaller than the diameter of each of inlets 413 and 413' and outlets 414 and 414, thus leaving gaps for allowing air to pass through. As a result, noise generated while air pump 40 is operating is also greatly reduced by such indirect air path.

While the invention has been described by means of specific embodiments, numerous modifications and variations could be made thereto by those skilled in the art without departing from the scope and spirit of the invention set forth in the claims.

What is claimed is:

1. An air pump for a fish-tank comprising;

a base plate;

a body comprising a frame, an inlet air chamber, an outlet air chamber divided by said frame, a first and a second inlets at said inlet air chamber, a first and a second outlets at said outlet air chamber, a slot on each of said first inlet and said first outlet, a discharge pipe, and a bottom casing comprising an air charge opening on an upper portion thereof in communication with outside, a compartmental air chamber assembly, an air charge tube extended down from said air charge opening to said compartmental air chamber assembly, a bottom end of said air charge tube urged against an inner wall of said base plate, and one or more third outlets around a periphery of said bottom end of said air charge tube;

a cap clung onto said frame;

a vibration mechanism secured to an outer surface of said cap, said vibration mechanism comprising a magnet at one side;

a pair of check mechanisms with said body sandwiched therebetween, each of said check mechanisms clung to said corresponding slot and comprising a block member and a diaphragm for regulating air passing through said first inlet and said first outlet;

a pad clung to a rear side of said body; and a rear plate clung to a rear side of said pad;

wherein air is guided into said air chamber assembly prior to leaving said discharge pipe.

2. The air pump of claim 1, wherein said base plate comprises a plurality of compartments and said air chamber assembly comprises a plurality of compartments each matingly engaged with said corresponding compartment of said base plate for forming a first, a second, a third, or a fourth air chamber.

3. The air pump of claim 2, further comprising a riser on a side of one compartment in each of said second and said third air chambers corresponding to said first outlet, each riser having a cross-sectional area smaller than a diameter of said first outlet, and a recess on each riser.

4. An air pump for a fish-tank comprising:

a pair of base plates;

a body comprising a frame, an inlet air chamber, an outlet air chamber divided by said frame, a first and a second inlets at said inlet air chamber, a first and a second outlets at said outlet air chamber; a slot on each of said first inlet and said first outlet, a discharge pipe, and a bottom casing comprising an air charge opening on an upper portion thereof in communication with outside, a pair of compartmental air chamber assemblies, an air charge tube extended down from said air charge opening to one of said compartmental air chamber assemblies, a bottom end of said air charge tube urged against an inner wall of one of said base plates, and one or more third outlets around a periphery of said bottom end of said air charge tube;

a pair of caps each clung onto said frame;

a pair of vibration mechanisms each secured to an outer surface of each cap, each vibration mechanism comprising a magnet at one side;

a pair of check mechanisms with said body sandwiched therebetween, each of said check mechanisms clung to said corresponding slot and comprising a block member and a diaphragm for regulating air passing through said first inlet and said first outlet;

a pad clung to a rear side of said body; and a rear plate clung to a rear side of said pad;

wherein air is guided into said air chamber assemblies prior to leaving said discharge pipe.

5. The air pump of claim 4, wherein each of said first and second inlets has a round opening, and each of said first and said second outlets has a round opening, further comprising a plurality of posts on each base plate corresponding to one of said round openings, said cross-sectional area of each post being smaller than a diameter of each of said first and said second inlets and each of said first and said second outlets so that each post is capable of inserting into said corresponding round opening.

* * * * *